US006162276A

United States Patent [19]

Berger et al.

[11] Patent Number: 6,162,276

[45] Date of Patent: Dec. 19, 2000

[54] COATING POWDER AND METHOD FOR ITS PRODUCTION

[75] Inventors: Lutz-Michael Berger; Manfred Nebelung, both of Dresden, Germany; Tapio Maentylae; Petri Vuoristo, both of Tampere, Finland

[73] Assignee: Fraunhofer-Gesellschaft Zu Forderung der Angewandten Forschung e.V.

[21] Appl. No.: 09/269,819

[22] PCT Filed: Sep. 25, 1997

[86] PCT No.: PCT/DE97/02207

§ 371 Date: Apr. 1, 1999

§ 102(e) Date: Apr. 1, 1999

[87] PCT Pub. No.: WO98/14630

PCT Pub. Date: Apr. 9, 1998

[30] Foreign Application Priority Data

Oct. 2, 1996 [DE] Germany ..... 196 40 788

[51] Int. Cl.[7] ..... B22F 1/00

[52] U.S. Cl. ..... 75/252; 75/356

[58] Field of Search ..... 75/242, 236, 238, 75/252, 356

[56] References Cited

U.S. PATENT DOCUMENTS

| | | | |
|---|---|---|---|
| 3,859,057 | 1/1975 | Stoll et al. | 29/182.7 |
| 4,233,072 | 11/1980 | Watanabe et al. | 75/236 |

FOREIGN PATENT DOCUMENTS

| | | | |
|---|---|---|---|
| 0425464 | 1/1995 | European Pat. Off. | C23C 4/02 |
| 224057 | 5/1984 | Germany | C23C 7/00 |
| 4134144 | 10/1991 | Germany | C23C 4/10 |
| 8704732 | 8/1987 | WIPO | C23C 4/06 |

OTHER PUBLICATIONS

Vuoristo P., Niemi K., Mantyla T., Berger L.–M., Nebelung M. Comparison of Different Hardmetal–like Coatings Sprayed by Plasma and Detonation Gu Process, Advances in Thermal Spray Science and Technology, Proc. 8th National Thermal Spray Conference, 11–15, Sep. 1995, Houston, Texas USA, Editors:C.C. Berndt, S.Sampath. Materials Park/Ohio: ASM Internatio 1995. —p.309–315.

Berger L.–M., Nebelung M., Mantyla T., Vuoristo P. Hartmetallahnliche gegan VerschleiB und Korrosion Maschinemarkt 1996 Jg. N8 S.28–33.

Berger L.–M., Hermel W. Vuoristo P., Mantyla T., Ettmeyer P. Hardmetal LI Coatings, TS96 Vortrage und Posterbeitrage der Thermischen Spritzonfere '96, 6–8. Marz 1996, Essen, Deutschland;Herausgeber; DVS–Berichte Band 175. Dusseldorf: Deutscher Verlag fur SchweiBtechnik, 1996 S.61–65.

Thiele S., Heimann R.B., Berger L.–M., Nebelung M., Schwarz K. Investigation of NovelVacuum Plasma–Sprayed (Ti,Mo)C–NiCoCoatings Journal of Materials Science Letters, 1996, vol. 15, No. 8, p. 683–685.

Berger L.M., Hermel W., Vuoristo P., Mantyla T., Lengauer W., EttmayerP. Structure and Properties of HardMetal–like Coatings Prepared by Thermal Spray Process., Proceedings of the 1996 European Conf. on ADv. in Hard Materials Production, May 27–29, 1996 Stockholm, Sweden, Shrewsbury/U.K.: European Power Metallurgy Association, 1996 p.443–450.

S.Economou et al., Wear, vol. 185, 1995, p. 93–110.

M.Yu.Zashlyapin et al., Sashchitnye pokrytiya na metallakh, Band 20, 1986, p. 52–55.

P. Vuoristo et al., TS 96: und Posterbeitrage der Thermischen Spritzkonfe 96, 6–8.Marz 1996, Essen, Herausgeber: E.Lugscheider, DVS–Berichte Band 175, Dusseldorf, Deutscher Verlaf fur SchweiBtechnik, 1996, S. 58–60.

P. Ettmayer et al., Int. J. Refractotry Metals & Hard Meterials, 1995, No. 6, vol. 13, p. 343–351.

R.F. Voitovich, Okislenie karbidov i nitridov, Kiev, Naukova dumka, 1981 p.86–92.

P. Ettmayer, H. Kolaska, Metall, 1989, Band 43, Heft 8, S.742–749.

J. Beczkowiak et al., Schweissen und Schneiden, 1996, Band 48, Heft 2, S.132–136.

Vuoristo P., Niemi K., Stenburg T., Mantyla T., Berger L.–M., Nebelung M. Hermel W. Structure and Wear Properties of Plasma and Detonation Gun Sprayed (Ti,Mo)C-NiCo Cermet Coatings Thermal Spraying—Current Status and Future Trends, Proc. 14th International Thermal Spray Confer May 22,–26, 1995, Kobe, Japan, Ed. By A.Ohmori. Osaka: High Tempurature Society of Japan, 1995.–vol. 2, p. 699–704.

*Primary Examiner*—Ngoclan Mai

*Attorney, Agent, or Firm*—Hayes, Soloway, Hennessey, Grossman & Hage, PC

[57] ABSTRACT

The invention relates to a coating powder and method for its production. Said powder can be used in many technical fields, specially in machine and vehicle construction in chemical and petro-chemical installations. This coating powder has a hardmetal-like microstructure and consists of two cubic hard material phases, each of them representing a nucleus-external surface structure of a hard material particle. The hard material phase in the nucleus contains mostly Ti and C and the hard material phase in the external surface mostly Ti, a second metal and C, which are embedded in a binder phase containing at least one or more elements such as Ni, Co and Fe. According to the invention, said coating powder is characterized by the fact that no additional alloying element exists either in the hard material phase, in the binder phase or in both phases simultaneously. According to the invention, the coating powder is produced by crushing and mixing and homogenizing the individual hard materials and the metal powder in an aqueous suspension in a ball triturator, which are later on granulated, sintered and processed using a grinding technique.

22 Claims, 4 Drawing Sheets

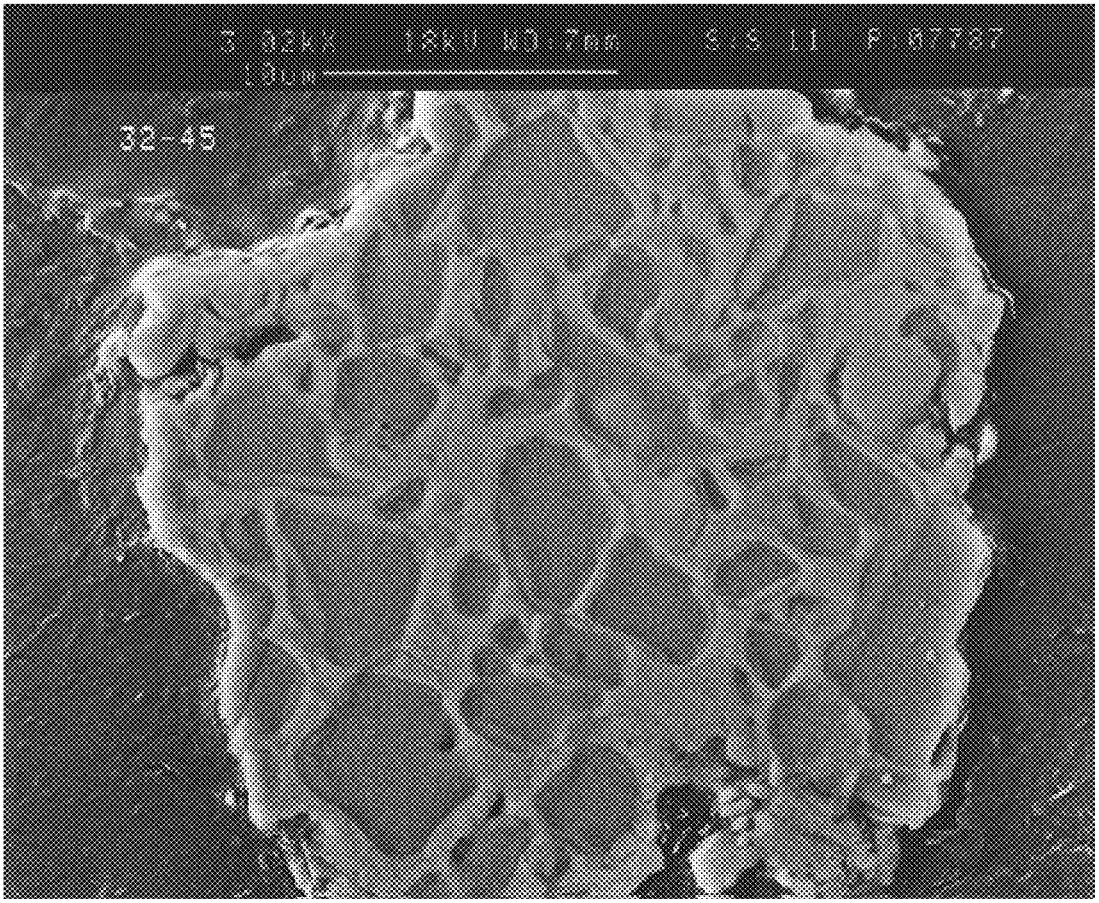
Fig. 1: Magnification 3000x of a metallographic cross-section of a particle of a coating powder according to Example 1.

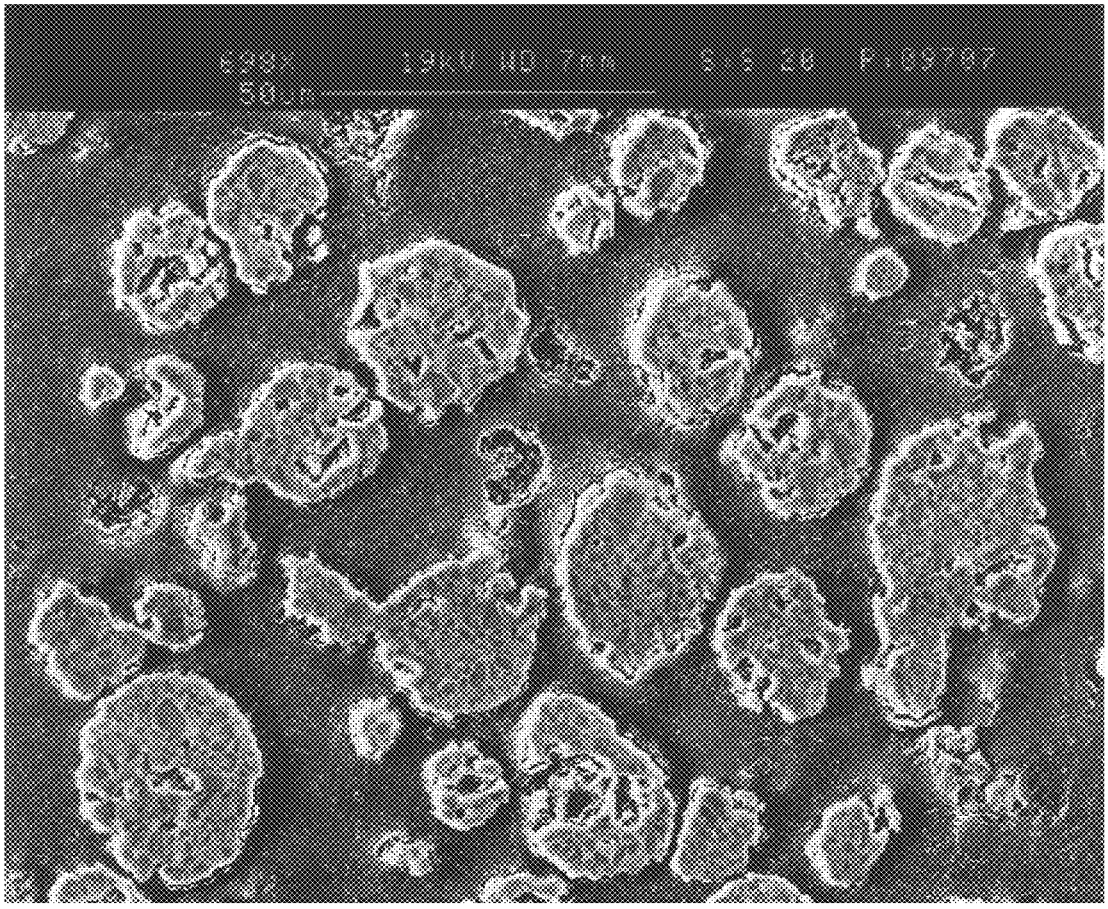
Fig. 2: Magnification 700x of a metallographic cross-section of several particles of a coating powder according to Example 2.

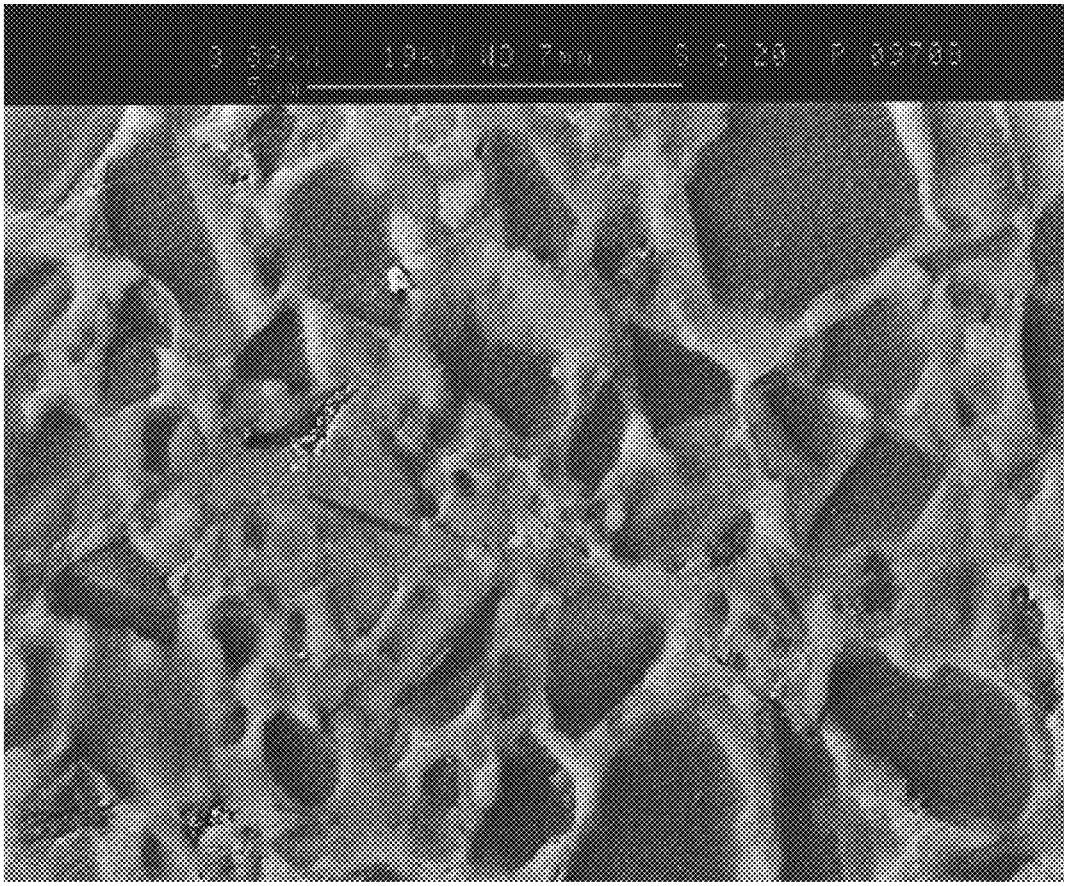
Fig. 3: Magnification 8000x of a metallographic cross-section of a particle of a coating powder according to Example 2.

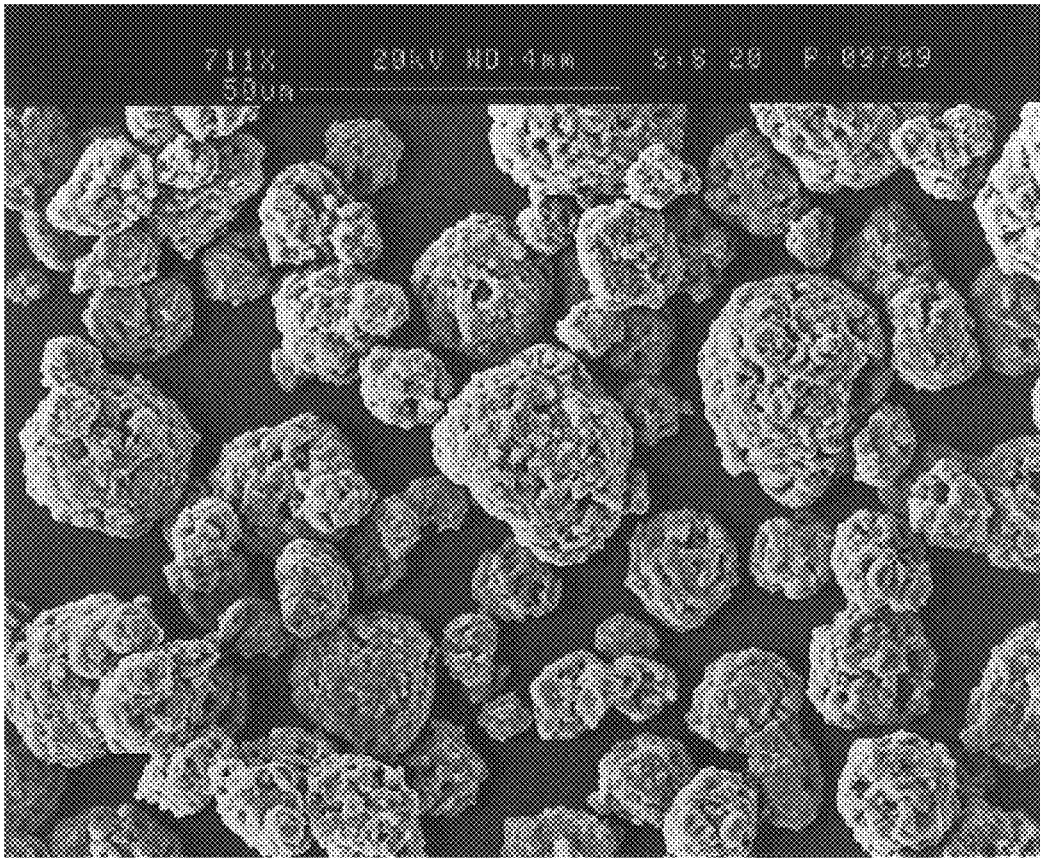
Fig. 4: Morphology of a coating powder according to Example 2 of the invention (magnification 700x).

COATING POWDER AND METHOD FOR ITS PRODUCTION

The invention concerns a coating powder for use in different coating technologies such as the different variants of thermal spraying, for example, plasma spray, high velocity oxy-fuel spraying (HVOF) and detonation spray, the same as other methods like coating by means of laser or plasma transferred arc (PTA) welding. By means of said methods the coating powder according to the invention can be applied to different highly stressed construction units which are exposed to the most varied stresses such as abrasive and erosive wear, corrosion and high temperatures, or to the most varied combinations of said stresses, being used in the most diverse technical fields. Examples of use are coated construction units in vehicles and machinery construction, chemical and petrochemical installations and many other branches of the economy.

Different hardmetal-like coating powders are widely used in technology. They are characterized by a carbide hard material such as WC or $Cr_3C_2$ embedded in a ductile binder matrix. The most important systems for coatings are WC-Co and $Cr_3C_2$-NiCr. WC-Co shows a very high resistance to wear. The use at elevated temperature (up to a maximum of 450° C.) and simultaneous chemical strain is limited. It has been sought by using other binders like Ni and alloys with chromium specially to improve the resistance to corrosion which due to the low alloying property of the system is only limitedly possible. On the other hand, $Cr_3C_2$-NiCr can be satisfactorily used at high temperatures (up to 750–800° C.) and corrosive strain. But the resistance to wear of the system is lower than that of WC-Co.

Because of their great hardness, low density and good availability, there have been repeatedly undertaken in the past tests for developing a hardmetal-like powdery coating material on a base of cubic Ti hard material phases [TiC or Ti(C,N)[7]] from which coatings not having the above mentioned disadvantages can be produced using current coating technologies, specially technologies associated with the process group of thermal spray, for example, plasma spray, high-velocity oxy-fuel spraying (HVOF) and detonation spray, the same as other methods such as coating by means of laser or plasma transferred arc (PTA) welding.

In DD 224 057 has been described a coating powder having a base of TiC which together with at least one of the metals Ni, Co, Cr, W as well as B and/or Si, also contains Mo or $Mo_2C$ and free carbon. Individual components such as $Mo_2C$ can here be bonded on the TiC. Due to the fact that there exists no composite powder having a hardmetal-like microstructure and the individual powder components are very coarse, no coatings very resistant to wear can be produced.

In DE 41 34 144 has been described a carbide spray powder where by coating with an active carbon the core should be protected against oxidation phenomena. As spray powders to be coated, there are mentioned, also titanium carbide and titanium carbonitride, in a matrix of metals of the group iron, nickel and cobalt.

Several patents describe methods for preparing hardmetal-like coatings with TiC as hard material phase or coated construction parts. WO 87/04732 describes a method for preparing a wear-resistant coating from a powder material which contains 10–50% by weight TiC and a Fe and/or Ni alloy, or a Co alloy. In these compositions the portion of the hard material phase is too low for decisively increasing the wear resistance.

U.S. Pat. No. 4,233,072 uses for coating piston rings mechanical mixtures of the composition 60–85% Mo, 10–30% of a NiCr alloy and 5–20% TiC. Together with the disadvantages due to the mechanical mixture, the hard material portion is also exceedingly low.

S. Economou et al (Wear, Vol. 185, 1995, pp. 93–110) describe several alloy variants of hardmetal-like coating powders with TiC, TaC or (Ti,Ta)C as hard material phase as well as NiCrMo or Mo as binder phases. The portion of the carbide hard materials was 60% vol. Said coating powder was prepared from the existing individual hard materials, a NiCr alloy powder and metallic molybdenum by agglomeration (interpreting SEM photographs a spray drying process must be assumed here) and sintering at 1200° C./6 h under argon. From X-ray investigations for the highest alloyed (Ti,Ta)C-NiCrMo coating powder it results that after sintering molybdenum was still detectable as phase. Therefore, the green density of the spray-dried, granulated material and/or the sintering temperature were too low completely to dissolve the molybdenum with the other components of the binder phase or to form a Mo-containing hard material phase. The grain size range of said coating was 25–90 $\mu$m or 20–75 $\mu$m. Nevertheless, comparing with one another the tested coating systems, the best coatings were obtained with the alloy variant (Ti,Ta)C-NiCrMo. Coatings using only TiC as hard material phase showed poor wear-resistant properties.

EP 0 425 464 describes a roller for use in the production of paper which is provided with several coatings. The surface coating constitutes a hardmetal-like coating, the hard material phase of which consists of tungsten, chromium, titanium, niobium or boron carbides or a mixture thereof and the metal binder phase of which consists of Ni, Co or Fe or alloys thereof, which can also be alloyed with transition metals of the IV to VI cosets of the PTE. The content of the hard material phase can amount up to 96%. Due to the insufficient microstructural formation in the coating powder, the substrates coated therewith show poor wear characteristic so that the field of use of such a coating remains limited to said special case.

M. Yu. Zashlyapin et al. (Sashchitnye pokytiya na metallakh, Vol. 20, 1986, pp. 52–55) describe coating powders having TiCN as hard material phase and binders consisting of 75% by weight Ni and 25% by weight Mo which are contained in the composite powder at 35–65% by weight. This corresponds to 65–78% by volume of hard material phase in the coating powder. According to the results of the X-ray analyses, the sintered spray powders consist of TiCN and a solid solution of TiCN and Mo in the nickel matrix. Due to the use of Mo as starting material and the small content of non-metals combined therewith, this powder is susceptible to oxidation and the substrates coating therewith show poor wear characteristic.

P. Vuoristo et al. (TS'96: Oral and poster presentations of the Thermal Spray Conference '96, Mar. 6–8, 1996, Essen, publisher: E. Lugscheider, DVS Reports, Vol. 175, D üsseldorf, Deutscher Verlag für Schweisstechnik, 1996, pp. 58–60) describe coating powders with (Ti,Mo)C as hard material phase and NiCo in the binder phase. The content of carbide hard materials in the coating powders amounted to 72 by vol. or 80% by vol. Said materials show core-rim structures of the hard material phases, the hard material phase in the core being a TiC and that in the rim a $(Ti,Mo)C_{1-x}$. The content of molybdenum is not specified. Although the coatings produced from said coating powders are better than those produced from TiC-containing coating powders of the prior art, still they are not so decisively improved (for example abrasive wear) as to be sufficiently superior and competitive in comparison with other hardmetal systems.

The problem to be now solved by this invention is to make possible to propose a coating powder on the base of cubic hard material phases with titanium as metal main component which by alloying techniques are easy to carry out so that the coating powders described in the prior art are decidedly improved and so that with current coating technologies coatings can be produced that are competitive or superior to the other hardmetal systems.

With this hardmetal-like coating powder proposed by the invention, it becomes possible to produce by conventional coating technologies highly stressed construction parts with hardmetal-like, extremely resistant coatings which compared to the known technical solutions have improved combinations of properties like high resistance to wear at high temperature, high resistance to wear at simultaneous highly corrosive strains, lower coefficients of friction at high temperature and which by varying the composition can be easily adapted to different stress profiles.

A problem to be solved by the invention at the same time is to indicate an economical method for preparing said spray powder.

In conformity with the invention these problems concerning the coating powder are solved according to one or more of claims 1 to 18 and concerning the method of preparation of said powder, according to one or more of claims 19 to 21.

The coating powder according to the invention is characterized by having a hardmetal-like microstructure. Here at least two cubic hard material phases which have a core-rim structure and form a hard material grain are embedded in a metal binder matrix consisting of at least one or more of the elements Ni, Co and Fe. Said core-rim structure is formed by metallurgical reactions, solution and reprecipitation phenomena in the sintering process during the preparation of the coating powder. The function of the hard material phase in the rim is to improve in particular the deficient wetting of the pure hard material TiC with the usual binder metals Ni, Co and Fe or alloys thereof. Specially adequate for this have proved to be the metals Mo and W which specially in the form of the carbides thereof $Mo_2C$ or WC are admixed as starting powders in the preparation of the coating powder. During the sintering process said carbides dissolve relative to the TiC preferably in the binder and in the cooling phase of the sintering process reprecipitate as mixed carbides $(Ti,Mo)C_{1-x}$ or $(Ti,W)C_{1-x}$ in the form of rims around undissolved TiC grains. Thus, in the coating powder compositions [for example (Ti, Mo)C-NiCo] and structures are formed as have already been described by P. Vuoristo et al (TS'96): Oral and poster presentations of the Thermal Spray Conference '96, Mar. 6–8, 1996, Essen, publisher: E. Lugscheider, DVS reports, Vol. 175, Düsseldorf, Deutscher Verlag für Schweisstechnik, 1996, pp. 58–60), as above explained in detail in the prior art. In metallographically prepared cross-sections of the coating powders the microstructures thereof are to a large extent identical to the microstructures of sintering bodies of analogous composition produced by powder metallurgy. But it has been found that such alloying degree (two-phase, cubic hard material particles with core-rim structure in a binder matrix of at least one or more of the elements Ni, Co and Fe) as the rule is insufficient for industrial uses and according to the invention said deficiency can be overcome by adding at least one other alloying element.

Nitrogen is advantageously added as one other alloying element. This is obtained by partly or wholly substituting titanium carbide by titanium carbonitride used as starting material for preparing the coating powder. From developments for cutting tools, it is known that by increasing the content of nitrogen, specially the Mo and/or W contents can be increased in the binder phase (P. Ettmayer et al., Int. J. Refractory Metals & Hard Materials, 1995, No. 6, Vol. 13, pp. 343–351). Due to the known fact that from carbonitrides at high temperatures such as appear in the thermal spray process nitrogen is set free, the use of nitrogen in a commercial hardmetal-like coating powder has to date been avoided. But it has been shown that by the microstructural formation of the coating powder according to the invention, the hard material phases are protected against nitrogen losses in the spraying process. The use of nitrogen-containing coating powders is specially advantageous when coatings with a low friction coefficient have to be produced. The elements Zr, Hf, V, Nb, Ta and Cr are also additional alloying elements according to the invention. They can be used both alone and together with nitrogen. Alloying elements such as Al, B and others are likewise advantageous in particular applications.

It is of special advantage to introduce for the preparation of the coating powders metal alloying elements in the form of carbides. This applies to the alloying elements Mo and W as well as to the other metal alloying elements Zr, Hf, V, Nb, Ta and Cr and both to nitrogen-free and to nitrogen-containing compositions of the coating powders according to the invention. This can result in that after the sintering process, together with cubic hard material phases forming the core-rim structure there can be detected other separately existing also non-cubic hard material phases. This occurs when there are exceeded the solution limits for said hard materials in the cubic hard material phases which form the core-rim structure. $Cr_3C_2$, $Cr_7C_3$, $Cr_{23}C_6$, WC, $W_2C$ and $Mo_2C$ can still be detected after the sintering process by X-ray diffraction analysis. For example, the orthorhombic $Cr_3Cr_2$ is still detectable after sintering by X-ray diffraction analysis when used in a certain amount. Many coating processes such as the plasma spray in air, the high velocity oxy-fuel spraying and the detonation spray lead to partial oxidation of hardmetal-like coating powders. It is known that the carbide hard materials $Cr_3C_2$, $Cr_7C_3$, $Cr_{23}C_6$, WC, $W_2C$ and $Mo_2C$ oxidize under formation of free carbon and a lower carbide of the metal—when it is stable—and then the metal itself is formed (R. F. Voitovich, Okislenie karbidov i nitridov, Kiev, Naukova dumka, 1981). This metal, which is formed, is capable further to alloy the metal binder. Thus, it is at the same time obtained that the alloying state of the binder is positively affected and that the oxygen content of the coating is reduced. The chromium which is formed by oxidation of the $Cr_3Cr_2$ considerably increases the resistance to corrosion of the binder. It is at the same time important that all carbide and carbonitride starting materials used for the preparation of coating powders have a low oxygen content. When using individual hard materials for the preparation of coating powders such as TiC, Ti(C,N), $Mo_2C$ or WC, with the exception of Ti, there are practically no other metals like Mo, W, Ta and Nb in the hard material phase forming the core. Together with the individual hard materials there can also be used pre-formed carbides and carbonitrides such as (Ti, Mo)C, (Ti,W)C or (Ti,W)(C,N). The consequence of such a procedure is that, as known from the development of cutting tools (P. Ettmayer et al., Int. J. Refractory Metals & Hard Materials, 1995, No. 6, Vol. 13, pp. 343–351), the hard material phase present in the core contains together with titanium other metals. Such a distribution of the alloying elements is likewise in accordance with the present invention. To the special extent this concerns also the use of Ti(C,N) as starting material. It is known that in the core of the hard material particles an increased concentration of the nitrogen results while in the rims the nitrogen content is small, but an increased concentration of Mo or W is observed (P. Ettmayer, H. Kolaska, Metall, 1989, Vol. 43, Number 8, pp. 742–749). According to the invention this means that the content of titanium and carbon in the cores of the hard materials amounts to >60 atom %, and at the same time in the rim the content of titanium, of the second metal and carbon amounts to >50 atom %. As a rule real values are clearly above the indicated limit values. In special alloying variants several rim phases can also be detected.

In principle, the volume ratio between the hard material phases and the binder phase can be varied within wide limits in the coating powder according to the invention, but a sufficiently high resistance to wear of the coatings is obtained only when the volume portion of the hard materials related to the starting materials prior to sintering amounts to >60% vol.

For preparing the coating powders according to the invention there can be used individual hard materials like TiC, TiN, Ti(C,N), $Mo_2C$, WC and $Cr_3C_2$ and also complex hard materials like (Ti,Mo)C and (W,Ti)C. But individual hard materials are preferably used. The carbon content of the titanium-containing hard materials is in the range of 4 to 21% by weight, the nitrogen content amounts to a maximum of 17% by weight. When using TiC or Ti(C,N), this corresponds to all compositions of the solid solution of TiC substantially up to $TiC_{0.3}N_{0.7}$. In the corresponding ratio, TiC and TiN can also be used as starting materials. Related to the starting materials prior to sintering and to the total hard material portion of the coating powders when using the individual hard materials TiC, TiN or Ti(C,N), the volume portion of said titanium-containing hard materials amounts to 50–95% vol., preferably 60–85% vol. In case of using a third hard material phase, the portion thereof amounts to a maximum of 35% vol., preferably a maximum of 25% vol. The portion of the second hard material phase responsible for the formation of the core-rim structure results from the difference.

The alloying elements such as W, Mo, Cr are preferably added as carbides and can dissolve during the sintering process in the preparation of coating powder both in the cubic hard material phases and partly in the binder phase.

The core-rim structure of the cubic hard material phases which is characteristic for the coating powder is transferred into the coating and is detectable therein. Another advantage of the coating powders according to the invention is that they can be processed to coatings nearly equal with the most different process variants of thermal spray technology.

With the solution according to the invention, it has been accomplished to prepare coating powders on the base of the hard material TiC by means of which coatings that are competitive or superior to the other hardmetal systems can be produced by current coating technologies, specially the technologies associated with the process group of the thermal spraying, for example, plasma spray, high velocity oxy-fuel spraying (HVOF) and detonation spray, as well as with other processes like coating by means of laser or plasma transferred arc (PTA) welding. Despite of all the efforts up to this date, this was impossible according to the prior art and has resulted in prejudices in the technical world in a manner such that it has been said, for example, that "TiC has only little importance on account of its inclination to oxidation and the resulting coating properties therefrom which can be overcome only by considerable precautions" (J. Beczkowiak et al., Schweissen and Schneiden, (Welding and Cutting), 1996, Vol. 58, Number 2, pp. 132–136).

The coating powder according to the invention can be produced by different technologies for coating powder production which include as most important technological step a sintering process, for example, like sintering and crushing. But with the technology of sintering and crushing the coating powder particles produced are of irregular morphology. For processing coating powders it has been found that a spherical morphology which increases the flowability of the powder is specially effective. Therefore, agglomeration and sintering have been used as preferred technology for preparing the spraying powders according to the invention. A spray drying process is advantageously used for agglomeration. The spray drying parameters are to be selected so as to obtain granules of high green density which are densified by a simple sintering process in which the core-rim structure of the hard material phases in the binder matrix can be formed. The high green density of the spray drying granules is also important in a manner that the sintering between individual granules remains limited to a minimum. The sintering process leads to a change in the phase composition of the coating powders due to the metallurgical reactions, solution, and reprecipitation reactions, the changes of the elementary composition are negligible. The size of the core-rim structured hard material particles in the sintered coating powder amounts to <10 μm, but preferably to <5 μm. After sintering, the lightly agglomerated by sintering of individual granules coating powder is finished by a careful milling process and then, for its use, according to the requirements, in one of the coating technologies mentioned, fractionized.

The grain size of the coating powder according to the invention must be adapted to the requirements of the coating technology used, wherefore it can be within a wide range of 10–250 μm.

The invention is explained hereby by several examples and accompanying drawings, wherein:

FIGS. 1–4 are photomicrographs of particles of coating powder made in accordance with the present invention.

EXAMPLE 1

59.6% wt. $TiC_{0.7}N_{0.3}$, 12% wt. $Mo_2C$ and 28.4% wt. Ni corresponding to 80.4% vol. hard material portion and 19.6% vol. binder portion are premixed dry, dispersed in water and then intimately mixed in a ball mill in high-grade steel containers with hardmetal balls. To the suspension is added 1.5% wt. of an adapted binder of polyvinyl alcohol and polyethylene glycol and then granules of spherical shape are produced by spray drying. The binder is removed together with the sintering in a one-step annealing operation. The binder removal and annealing are carried out in flat graphite crucibles under argon at a heating rate of 5 K/min up to 600° C. and 10 K/min up to the sintering temperature of 1320° C. followed by an isothermal treatment of 30 min. FIG. 1 shows the metallographic cross-section of a coating powder particle 3000 times enlarged. The core-rim structure of the hard material particles is clearly to be detected. The sintered powders are subjected to a careful milling and thereafter, depending on requirements, fractionated for use in the different coating technologies. For use in the high velocity oxy-fuel spraying or detonation spraying, the preferred grain size amounts to 20–45 μm. The d10 in this powder corresponds to 20 μm, the d90 to 42 μm.

The powder with the grain size of 20–45 μm was processed with a detonation spray equipment "Perun P" (Paton Institut, Ukraine) with a barrel having a length of 660 mm and 21 mm diameter to form coatings having a thickness of approximately 250 μm on steel substrates adequate for the abrasion test. Here were used the spraying conditions optimized for this material. The spraying distance was 120 mm with a firing rate of 6.6 detonations/s. An acetylene/oxygen mixture in the volume ratio of 1.0 was used. These coatings were subjected to an abrasion wear test according to U.S. standard ASTM G 65-85 without corrosive strain. The weight loss after 5904 m wear length amounted to 110 mg. For comparison with standard materials, in view of the density difference, this must be converted to $mm^3$ and amounted to 16.5 $mm^3$. In tests with the standard materials WC-12%Co and $Cr_3C_2$-25%NiCr, the amount of volume losses corresponds to 7.0 $mm^3$ and 15.9 $mm^3$. These materials were sprayed with the parameters optimal for them, that is, the volume ratio of the acetylene/oxygen mixture amounted to 1.3.

EXAMPLE 2

From 59.6% wt TiC, 12.0% wt. $Mo_2C$, 8.5% wt. $Cr_3C_2$ and 19.9% wt. Ni and corresponding therewith 86.8% vol. hard material portion and 13.2% vol. binder portion, a coating powder was prepared following the same procedure as in Example 1. Differences resulted in the sintering temperature which here amounted to 1300° C. FIG. 2 shows the metallographic cross-section through several particles of the coating powder 700 times enlarged. The microstructure of one of said coating powder particles is shown in FIG. 3 enlarged 8000 times. The portion of the light binder phase is substantially less than in the coating powder of Example 1. Together with hard material particles having a core-rim structure, particles of a third carbide hard material phase are observed. The coating powder was fractionated, for spraying tests there was also used a grain size range of 20–45 μm. The morphology of said spraying powder according to the invention is shown in FIG. 4. The coating powder was processed under spraying conditions similar to Example 1 with the detonation spraying equipment "Perun P" (Paton Institut, Ukraine), also to form coatings with a thickness of approximately 250 μm on steel substrates adequate for the abrasion test. The weight loss after 5904 m wear length amounted to 68 mg, when converted to the volume loss 10.6 $mm^3$.

EXAMPLE 3

From 59.6% wt $TiC_{0.7}N_{0.3}$, 12.0% wt. $Mo_2C$, 8.5% wt $Cr_3C_2$ and 19.9% wt Ni and corresponding therewith 86.5% vol. hard material portion and 13.5% vol. binder portion, a coating powder was produced following the same procedure of Example 1. Differences resulted in the sintering temperature which here amounted to 1300° C. The microstructure of this coating powder corresponds to that of Example 2. The coating powder was fractionated, for spraying tests there were likewise used grain sizes of 20–45 μm. The coating powder was processed under spraying conditions similar to those of Example 1 with the detonation spraying equipment "Perun P" (Paton Institut, Ukraine) also to form coatings having a thickness of approximately 250 μm on steel substrates adequate for the abrasion test. The weight loss after 5904 m wear length amounted to 58 mg, when converted to the volume loss 8.9 $mm^3$.

EXAMPLE 4

From 56.5% wt. TiC, 12.0% wt $Mo_2C$, 3.0% wt NbC and 28.5% wt Ni and corresponding therewith 80.4% vol hard material portion and 19.6% vol. binder portion, a coating powder was prepared following the same procedure as in Example 1. Differences resulted in the sintering temperature which amounted here to 1300° C. The microstructure of said coating powder corresponds to that in Example 2. The coating powder was fractionated, for spraying tests there were also used grain sizes of 20–45 μm. The coating powder was processed under spraying conditions similar to Example 1 with the detonation spraying equipment "Perun P" (Paton Institut, Ukraine) also to form coatings with a thickness of approximately 250 μm on steel substrates adequate for the abrasion test. The weight loss after 5904 wear length amounted to 80 mg, when converted to the volume loss 12.1 $mm^3$.

EXAMPLE 5

A coating powder from Example 1 was sprayed with a PT A-3000S plasma spraying equipment with a F4 torch in air also on steel substrates adequate for the abrasion test. For this purpose was used an $Ar/H_2$-plasma (best results at 45 l/min Ar and 14 l/min $H_2$) with a plasma power of 38 kW. The weight loss after 5904 wear length amounted to 100 mg when converted to the volume loss 16.4 $mm^3$.

For coatings of the standard materials WC-12%Co and $Cr_3C_2$-25% NiCr sprayed with the same equipment the amount of volume losses corresponded to 10.8 $mm^3$ and 20.3 $mm^3$, respectively. These materials were sprayed with the optimum parameters for them, that is, using an Ar/He plasma (Ar: 60 l/min, He 120 l/min, 44 kW plasma power, 110 mm spraying distance).

EXAMPLE 6

A coating powder from Example 1 was sprayed by high velocity oxy-fuel spraying with a PT CDS spraying equipment with a gaseous mixture of hydrogen (600 l/min) and oxygen (300 l/min) with a spraying distance of 200 mm likewise on steel substrates adequate for the abrasion test. The weight loss after 5904 wear length amounted to 94 mg, when converted to the volume loss 15.4 $mm^3$.

What is claimed is:

1. Coating powder having a hardmetal-like microstructure consisting of two cubic hard material phases which respectively constitute a core-rim structure of hard material particles wherein the hard material phase in the core contains mostly Ti and C and the hard material phase in the rim contains mostly Ti, a second metal and C and these are embedded in a binder phase consisting of at least one or more of the elements Ni, Co and Fe, wherein either in the hard material phases or in the binder phase, or in both simultaneously at least one other alloying element is present, and in the metal binder phase optionally is embedded at least one third carbide hard material phase which during the spraying processes under oxygen-containing atmosphere decomposes with carbon loss and the metal component thereof alloys the other hard material phases and/or the binder phase, or remains dissolved in the binder as carbide due to the quick cooling.

2. Coating powder according to claim 1, wherein the cubic hard material phase in the rim contains as said second metal Mo or W.

3. Coating powder according to claim 1, wherein the other alloying elements are N and/or at least one element selected from the group consisting of Zr, Hf, V, Nb, Ta and Cr.

4. Coating powder according to claim 1, wherein the metal binder phase is additionally alloyed by W and/or Mo, but one or both elements are simultaneously contained in the cubic hard material phase that forms the rim.

5. Coating powder according to claim 1, wherein the third or each further added carbide phase has a cubic or other crystal lattice.

6. Coating powder according to claim 1, wherein the carbide phases are $Cr_3C_2$, $Cr_7C_3$, $Cr_{23}C_6$, WC, $W_2C$ and $Mo_2C$.

7. Coating powder according to claim 1, wherein the volume portion of the total of the hard materials related to the total volume of the materials prior to the sintering amounts to >60% vol.

8. Coating powder according to claim 7, wherein the volume portion of the hard materials related to the total volume of the materials prior to sintering is within the 70–95% vol. range.

9. Coating powder according to claim 8, wherein the volume portion of the hard materials related to the total volume of the materials prior to sintering is within the 80–95% vol. range.

10. Coating powder according to claim 1, wherein related to the total of the materials prior to sintering, the titanium-containing hard materials have up to 4–22% wt carbon content.

11. Coating powder according to claim 7, wherein the volume portion of the titanium-containing hard materials when using the individual hard materials TiC, TiN or Ti(C, N) amounts to 50–95% vol. related to the total volume of the materials prior to sintering and to the total portion of hard materials.

12. Coating powder according to claim 11, wherein the volume portion of the titanium-containing hard materials when using the individual hard materials TiC, TiN or Ti(C, N) amounts to 60–90% vol. related to the total volume of the materials prior to sintering and to the total portion of hard materials.

13. Coating powder according to claim 1, wherein the volume portion of the third carbide hard material phase amounts to a maximum of 35% vol. related to the total volume of the materials prior to sintering and to the total portion of hard material.

14. Coating powder according to claim 13, wherein the volume portion of the third carbide hard material phase amounts to a maximum of 25% vol related to the total volume of the materials prior to sintering and to the total portion of hard materials.

15. Coating powder according to claim 1, wherein the grain size of the particles following sintering is within the range of 10–250 $\mu$m.

16. Coating powder according to claim 15, wherein the grain size of the particles following sintering is within the range of 20–90 $\mu$m.

17. Coating powder according to claim 16, wherein the grain size of the particles following sintering is within the range of 20–45 $\mu$m.

18. Coating powder according to claim 15, wherein the particles following sintering have a spherical morphology.

19. Process for the preparation of the coating powder according to claim 1, wherein the hard material particles are mixed and homogenized in an aqueous suspension by mixed grinding in a ball-type mill and then granulated, sintered and prepared using a grinding technique.

20. Process for the preparation of the coating powder according to claim 19, wherein the granulation is carried out by spray drying.

21. Process for the preparation of the coating powder according to claim 19, wherein the sintering is carried out depending on the alloy composition at temperatures at which a sufficient amount of liquid phase is formed, which makes possible the metallurgic reactions, solution, and re-precipitation reactions needed to form therefrom the core-rim structure of the cubic hard material phases.

22. Coating powder according to claim 1, wherein related to the total of the materials prior to sintering, the titanium-containing hard materials comprise TiN or Ti(C,N) having up to 17% wt nitrogen content.

* * * * *

UNITED STATES PATENT AND TRADEMARK OFFICE

CERTIFICATE OF CORRECTION

PATENT NO. : 6,162,276
DATED : December 19, 2000
INVENTOR(S) : Lutz-Michael Berger It is certified that error appears in the above-identified patent and that said Letters Patent is hereby corrected as shown below:

Title page,
Item [56], OTHER PUBLICATIONS,
"MANTYLA" should be -- MAENTYLAE --, "MANTYLA" should be -- MAENTYLAE --, "MANTYLA" should be -- MAENTYLAE --, "MANTYLA" should be -- MAENTYLAE --, and "MANTYLA" should be -- MAENTYLAE --

Signed and Sealed this

Twenty-eighth Day of May, 2002

*Attest:*

*Attesting Officer*

JAMES E. ROGAN
*Director of the United States Patent and Trademark Office*

UNITED STATES PATENT AND TRADEMARK OFFICE

CERTIFICATE OF CORRECTION

PATENT NO. : 6,162,276
DATED : December 19, 2000
INVENTOR(S) : Berger et al.

It is certified that error appears in the above-identified patent and that said Letters Patent is hereby corrected as shown below:

Title page,
Item [73], Assignee should read -- Fraunhofer-Gesellschaft Zur Foerderung der Angewandten Forschung e.V. --.

Item [56], OTHER PUBLICATIONS,
Please change “Gu” to -- Gun --.
Please change "Internation" to -- International --.
Please change "metallahnlich" to -- metallaehnliche --;
After metallaehnliche please insert -- Schichten --; please change "gegan" to -- gegen --;
Please change VerschleiB" to -- Verschleiss --; and please change "maschinemarkt" to -- Maschinenmarkt --.
Please insert -- (Vol.) 102 -- after "Jg"; please change "S" to -- p. --.
Please change "L-M." to -- L.M. --; please insert -- Lengauer W., -- after "Mantyla"; please change "Ettmeyer" to -- Ettmayer --.
Please change "Hardmetal LI" to -- Hardmetal-like --; after "Coatings" please insert -- a Comparison of Properties and Potentials of the Different Systems --; please change "Vortrage" to -- Vortraege --; please change "Posterbeitrage" to -- Posterbeitraege --.
Please change "Spritzonfere" to -- Spritzkonferenz --; please change "Marz" to -- Maerz --.
Please insert -- F. Lugscheider -- after "Herausgeber;", please change "Dusseldorf" to -- Duesseldorf --.
Please change "SchweiBtechnik" to -- Schweisstechnik --.
Please change "S" to -- 5 --.
Please change "HardMetal" to -- Hardmetal --.
Please change "Process" to -- Processes --.
Please change "Adv" to -- Adv. --.
Please insert -- Vortraege -- after "96:"; please change "Posterbeitrage" to -- Posterbeitraege --.
Please change "Spritzkonfe" to -- Spritzkonferenz --; please change "Marz" to -- Maerz --; after "Essen," please insert -- Deutschland; --.

UNITED STATES PATENT AND TRADEMARK OFFICE

CERTIFICATE OF CORRECTION

PATENT NO. : 6,162,276
DATED : December 19, 2000
INVENTOR(S) : Berger et al.

It is certified that error appears in the above-identified patent and that said Letters Patent is hereby corrected as shown below:

Item [56], OTHER PUBLICATIONS, cont'd.
Please change "Dusseldorf" to -- Duesseldorf --.
Please change "Verlaf" to -- Verlag --; please change "SchweiBtechnik" to -- Schweisstechnik --; please change "S" to -- 5 --.
Please change "no additional" to -- at least one other --.
Please change "exists" to -- is present --.

Signed and Sealed this

Twenty-eighth Day of January, 2003

JAMES E. ROGAN
*Director of the United States Patent and Trademark Office*